United States Patent [19]

Asami

[11] 4,440,135

[45] Apr. 3, 1984

[54] FUEL INJECTION SYSTEM PROVIDED WITH FUEL INJECTION VALVES HAVING CONTROLLABLE VALVE OPENING PRESSURE

[75] Inventor: Toshiaki Asami, Matsuyama, Japan

[73] Assignee: Diesel Kiki Co., Ltd., Tokyo, Japan

[21] Appl. No.: 367,681

[22] Filed: Apr. 12, 1982

[30] Foreign Application Priority Data

Apr. 16, 1981 [JP] Japan ..... 56-55048[U]

[51] Int. Cl.[3] ..... F02M 47/02; F02M 51/00

[52] U.S. Cl. ..... 123/467; 123/446; 123/458

[58] Field of Search ..... 123/467, 458, 462, 447, 123/500, 501, 446; 239/88-95, 533.1, 533.12, 585

[56] References Cited

U.S. PATENT DOCUMENTS

| | | | |
|---|---|---|---|
| 3,908,621 | 9/1975 | Hussey | 123/467 |
| 3,943,901 | 3/1976 | Takahashi | 123/467 |
| 4,036,192 | 7/1977 | Nakayama | 123/467 |
| 4,167,168 | 9/1979 | Yamamoto | 123/467 |
| 4,213,434 | 7/1980 | Vogtmann | 123/462 |
| 4,359,032 | 11/1982 | Ohie | 123/467 |

FOREIGN PATENT DOCUMENTS

| | | | |
|---|---|---|---|
| 2729826 | 1/1978 | Fed. Rep. of Germany | 123/467 |

*Primary Examiner*—Charles J. Myhre
*Assistant Examiner*—Carl Stuart Miller
*Attorney, Agent, or Firm*—Frishauf, Holtz, Goodman & Woodward

[57] ABSTRACT

A fuel injection system includes fuel injection valves arranged to be supplied with part of pressurized fuel which is being supplied to or has been supplied to a fuel injection pump from a fuel feed pump. The pressurized fuel supplied to the injection valves acts upon the nozzle needles against their lifting motions to cause the valves to operate with higher valve opening pressure. The supply of the pressurized fuel to the valves is controlled as a function of an operating condition of an engine associated with the fuel injection system. For instance, the fuel supply is carried out when the rotational speed of the engine exceeds a predetermined rpm, so that higher valve opening pressure is available when the engine operates in a high rpm region.

14 Claims, 3 Drawing Figures

BACK PRESSURE P
ENGINE RPM N
P2
P1
N1
N2
1
1a
2
3
4
5
6
7
8
9
10
10a
11
12
13
14
15
16
17
17a
17b
18
18a
18b
19
20
21
22
23
f

FUEL INJECTION SYSTEM PROVIDED WITH FUEL INJECTION VALVES HAVING CONTROLLABLE VALVE OPENING PRESSURE

BACKGROUND OF THE INVENTION

This invention relates to a fuel injection system for use with an internal combustion engine, and more particularly to a fuel injection system which is adapted to control the valve opening pressure of the nozzle needles of the fuel injection valves by means of the pressure of fuel leaked from the valves.

Conventionally, a fuel injection system has been proposed, e.g. by U.S. Pat. No. 4,213,434, which is arranged such that fuel leaked from a fuel injection valve is stored in a drain passage leading to a lower pressure zone in a manner that the stored fuel acts upon the nozzle needle of the valve as back pressure. The amount of leaked fuel draining to the lower pressure zone is controlled as a function of one or more operating parameters of an associated engine, so as to vary the back pressure acting upon the nozzle needle to thereby control the valve opening pressure of the fuel injection valve.

On the other hand, it is known that the injection rate, i.e. injection quantity per unit period of time can be reduced, or the injection period can be lengthened in a low engine speed region, by setting the valve opening pressure of the fuel injection valve at a lower value in the low engine speed region, to thereby prevent knocking due to an ignition lag in an engine cylinder as well as combustion noize due to sudden explosive combustion in an engine cylinder lasting for a short period of time, while in a high engine speed region, the injection rate can be elevated by setting the valve opening pressure at a higher value, to obtain good output characteristics of the engine and also prevent the occurrence of nitrogen oxides (NOx).

However, according to conventional arrangements utilizing leaked fuel pressure for control of the valve opening pressure of fuel injection valves as aforementioned, the amount of fuel leaked from a fuel injection valve is relatively large in a low engine speed region, whereas in a high system speed region, the amount of the leaked fuel is relatively small, resulting in insufficient valve opening pressure. The engine therefore cannot achieve good output performance in the high speed region. Particularly, when the engine is rapidly accelerated from a lower speed region to a higher speed region, the back pressure acting upon the nozzle needles cannot be quickly increased to such a high level as to increase the valve opening pressure to a sufficient level, which renders it impossible for the engine to achieve good accelerating performance.

It is a general tendency with an ordinary fuel injection pump that there occurs a gradual increase in the fuel injection quantity as the engine rpm increases, provided that the control rod of the pump remains constant in position. This tendency is intensified by the above-mentioned low valve opening pressure of the fuel injection valve in a high engine speed region, making it the more difficult to control the fuel injection quantity with accuracy.

OBJECT AND SUMMARY OF THE INVENTION

It is therefore the object of the invention to provide a fuel injection system in which fuel pressure supplied from a fuel feed pump is utilized for control of the back pressure acting upon the nozzle needles of fuel injection valves, to thereby overcome all of the aforementioned conventional disadvantages.

A fuel injection system according to the present invention includes first supplementary back pressure applying means for causing the pressure of leaked fuel produced by lifting motion of the nozzle needle of a fuel injection valve to act upon the nozzle needle against its lifting motion, and second supplementary back pressure applying means responsive to an operating condition of an engine associated with the system for causing the pressure of pressurized fuel supplied from fuel pressure feeding means, e.g. a fuel feed pump, to act upon the nozzle needle against its lifting motion.

The second supplementary back pressure applying means preferably comprises a first passageway connecting the fuel pressure feeding means to the fuel injection valve for feeding pressurized fuel supplied from the fuel pressure feeding means and being applied to the nozzle needle, a second passageway connecting the fuel injection valve to a lower pressure zone for guiding the leaked fuel and the pressurized fuel to the lower pressure zone, a valve arranged for opening and closing the second passageway, and means responsive to an operating condition of the engine for controlling the valve.

The above and other objects, features and advantages of the invention will be more apparent from the ensuing detailed description taken in connection with the accompanying drawings.

DETAILED DESCRIPTION

Figures 1, 2:
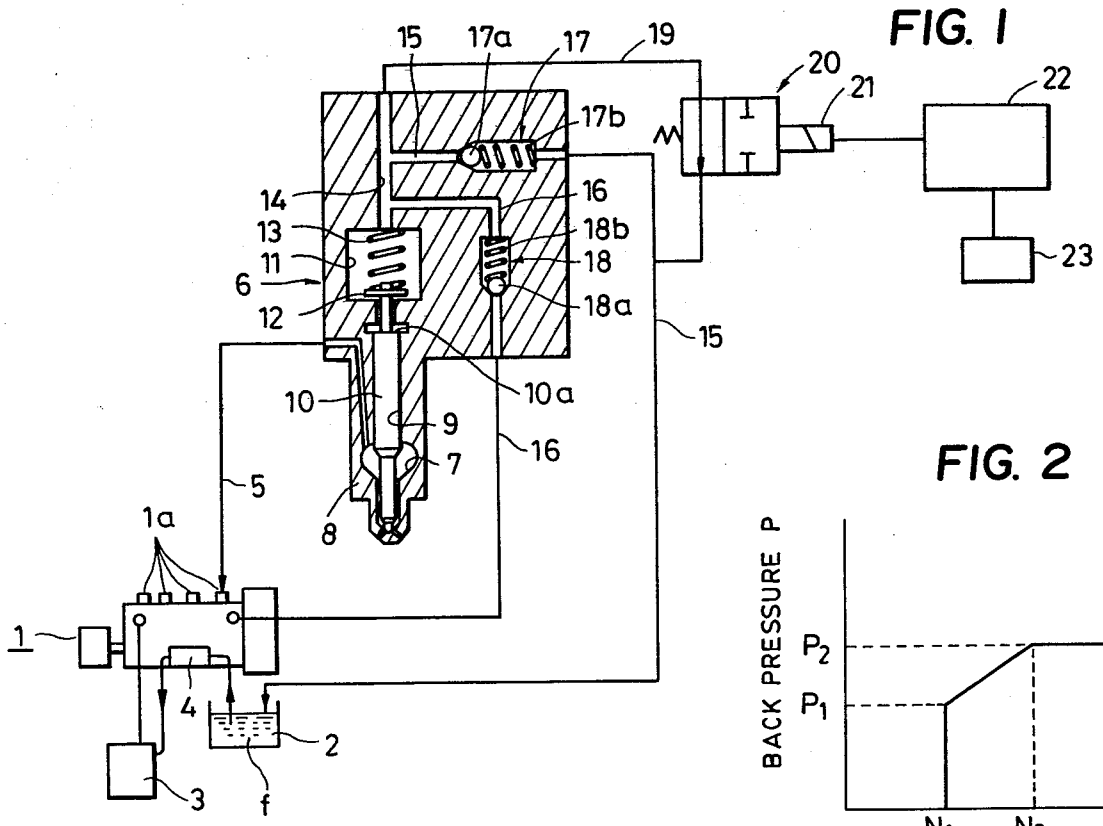
FIG. 1 is a block diagram of a fuel injection system according to an embodiment of the present invention.
FIG. 2 is a graph showing the relationship between the leaked fuel pressure and the engine rotational speed, which is available with the fuel injection system according to the invention.

Referring first to FIG. 1, reference numeral 1 designates a fuel injection pump which is provided with four plunger pumps 1*a*. The four plunger pumps 1*a* each have a suction gallery, not shown, surrounding a plunger barrel, not shown, and which is connected to a fuel tank 2 via a filter 3 and a fuel feed pump 4. The fuel feed pump 4 is mounted on a side wall of the fuel injection pump 1 in a manner being driven by a camshaft, not shown, for driving the plunger pumps 1*a* of the fuel injection pump 1. The plunger pumps 1*a* are each connected at its delivery side to a pressure chamber 7 formed in a corresponding fuel injection valve 6, via an injection pipe 5. In the fuel injection valve 6, a nozzle needle 10 is slidably fitted in a bore 9 formed within a housing 8. The nozzle needle 10 is disposed in contact with a spring seat 12 arranged in a nozzle spring chamber 11 formed in the housing 8 in communication with the bore 9. A nozzle spring 13 is arranged within the nozzle spring chamber 11 and urges the nozzle needle 10 in its seating or valve closing direction via the spring seat 12. The nozzle spring chamber 11 is filled with fuel leaked through the gap between the nozzle needle 10 and the bore 9.

Further formed in the housing 8 is a leakage or drain passage 14, which extends from the nozzle spring chamber 11 and is connected to a first return line 15 leading to the fuel tank 2 for returning the leaked fuel thereto, and also connected to a supplementary fuel pressure supply line 16 communicating with a corresponding one of the suction galleries of the fuel injection pump 1 for feeding the pressurized fuel in the suction gallery to the nozzle spring chamber 11. A first check valve 17 is arranged across the first return line 15, and a second check valve 18 across the supply line 16, respectively.

The leakage passage 14 is further connected to a second return line 19 which is arranged in parallel with the first return line 15 in a manner bypassing the first check valve 17 and communicates with the first return line 15 at a location downstream of the valve 17. A solenoid valve 20, which is a two port/two position type, is arranged across the second return line 19 for opening and closing same. The solenoid valve 20 has a solenoid 21 connected to an electronic control unit 22 to which is connected a sensor 23 for detecting the rotational speed of an engine associated with the system of the invention.

The above first check valve 17 comprises a ball 17*a* and a spring 17*b* urging the ball 17*a* in the valve closing direction. The spring 17*b* has such a setting load that the valve 17 is opened when the pressure in the leakage passage 14 or back pressure acting upon the nozzle needle 10 exceeds a predetermined value, for instance, a value required for obtaining a desired value of the valve opening pressure of the fuel injection valve 6.

The second check valve 18 comprises a ball 18*a*, and a spring 18*b* urging the ball 18*a* in the valve closing direction. The spring 18*b* has such a setting load that the valve 18 is opened when the pressure in the leakage passage 14 or back pressure acting upon the nozzle needle 10 exceeds the pressure in a corresponding suction gallery of the fuel injection valve 1. When closed, the valve 18 acts to prevent back flow of the leaked fuel in the fuel injection valve 6 to the suction gallery in the above event.

The solenoid valve 20 is a normally opened type. It is controlled by the electronic control unit 22 in response to the output of the engine speed sensor 23, in such a manner that it is opened when the engine rpm is lower than a predetermined value $N_1$, and closed when the former exceeds the latter. The engine speed sensor 23 can be formed by an electromagnetic pickup which can be arranged around the output shaft of the engine, for instance. Output pulses generated from the electromagnetic pickup 23 are applied to a D/A converter, for instance, of the electronic control unit 22, and the resultant analog voltage value is compared with a reference voltage value indicative of the predetermined engine rpm $N_1$. The resultant output control signal generated from the control unit 22 is applied to the solenoid 21 to energize or deenergize same for opening or closing the valve 20.

The operation of the arrangement of the invention described above will now be explained. When the fuel injection pump 1 is driven by means of rotation of the camshaft connected to the engine, the fuel feed pump 4 is correspondingly driven to suck up fuel f from the fuel tank 2 and feed it under pressure to the suction galleries of the fuel injection pump 1 via the filter 3. The fuel in the suction galleries is pumped by the plungers of the plunger pumps 1*a* and fed under high pressure to the pressure chamber 7 of each fuel injection valve 6 through the injection pipe 5, to cause the nozzle needle 10 to be lifted for injection of the fuel into an engine cylinder associated with the injection valve 6. During this injection operation, part of the fuel in the pressure chamber 7 leaks through the gap between the nozzle needle 10 and the bore 9 into the nozzle spring chamber 11. This leaked fuel acts upon the rear end face 10*a* of the nozzle needle 10 as back pressure in a manner assisting the urging action of the nozzle spring 13 to cause the nozzle needle 10 to operate with elevated valve opening pressure. On the other hand, the fuel in the suction galleries in the fuel injection pump 1 overflows into the supply line 16 and fed into the leakage passage 14 under substantially constant pressure, via the second check valve 18.

In a low engine speed region where the engine rpm is lower than the predetermined value $N_1$, the electronic control unit 22 outputs a control signal having a low level responsive to the output of the engine speed sensor 23 and applies it to the solenoid 21 of the solenoid valve 20 to deenergize the solenoid 21. Thus, the solenoid valve 20 is in its open position to allow the fuel in the leakage passage 14 to be returned to the fuel tank 2 through the second return line 19. Accordingly, on this occasion, the urging force of the nozzle spring 13 alone acts upon the nozzle needle 10 as back pressure. Therefore, in the low engine speed region, the valve opening pressure of the fuel injection valve 6 can be set to a sufficiently low and suitable value determined substantially solely by the setting load of the nozzle spring 13, which enables setting the injection rate to a sufficiently low value or setting the injection period to a sufficiently large value for prevention of combustion noise and knocking of the engine at idling, etc.

On the other hand, in a high engine speed region where the engine rpm is higher than the predetermined value $N_1$, the solenoid valve 20 has its solenoid 21 supplied with a control signal having a high level from the electronic control unit 22 and accordingly is in its closed position. Therefore, the pressure of fuel leaked from the nozzle needle 10 and the pressure of fuel overflowing from the supplementary fuel supply line 16 prevail in the nozzle spring chamber 11 so that high back pressure, which is the sum of the above two pressures and the urging force of the nozzle spring 13, acts upon the end face 10*a* of the nozzle needle 10, to obtain sufficiently elevated valve opening pressure of the valve 6, which in turn enables carrying out fuel injection at a higher injection rate, resulting in good output performance of the engine as well as restraint of the production of nitrogen oxides (NOx) in the exhaust gases. Further, the elevated valve opening pressure causes fuel to be injected under higher pressure to obtain finer particles of atomized fuel, resulting in good combustion in the engine cylinder. Moreover, the arrangement of the invention enables setting the valve opening pressure to a higher value in a high engine speed region than in a low engine speed region, which can avoid a gradual increase in the injection quantity with an increase in the engine rotation speed, to facilitate control of the injection quantity.

Particularly, the accelerating performance of the engine, which was conventionally not well achieved due to the phenomenon of a smaller amount of fuel leaked from the nozzle needle 10 in a high engine speed region, can be improved by the arrangement of the invention of supplying the nozzle spring chamber 11 with fuel fed from the fuel feed pump 4. That is, by closing the valve 20 upon accelerating the engine from a lower engine speed region to a higher engine speed region, the back pressure upon the nozzle needle 10 can then be instantly elevated to a sufficiently higher level even when the amount of leaked fuel is small, to obtain good accelerating performance of the engine and also prevent knocking and hunting of the engine.

Next, when the pressure in the nozzle spring chamber 13, i.e. that in the leakage passage 14 rises above a value corresponding to a desired valve opening pressure value, the first check valve 17 is opened by the excessive pressure in the passage 14 so that the fuel in the nozzle spring chamber 11 is returned from the leakage passage 14 to the fuel tank 2 through the return line 15, maintaining the fuel pressure in the nozzle spring chamber 11 at a substantially constant value.

FIG. 2 graphically shows the operating characteristic of the system of the invention. It will be learned from the graph that when the engine rpm N is lower than the predetermined value $N_1$, the pressure in the leakage passage 14 or back pressure P acting upon the nozzle needle 10 is zero, since the solenoid valve 20 is then opened; when the engine rpm N reaches the predetermined value $N_1$, the back pressure P instantly increases up to a value $P_1$ due to closing of the solenoid valve 20; and as the engine rpm N then further increases from the value $N_1$, the back pressure P gradually increases from the value $P_1$. When a higher engine rpm $N_2$ is reached which corresponds to the valve opening pressure of the first check valve 17, the back pressure P is maintained at a higher value $P_2$.

Although in the embodiment described above, the solenoid valve 20 is used for controlling the back pressure acting upon the nozzle needle 10, another type of valve may be used in place of the solenoid valve 20, such as a rotary valve which can be advantageously controlled by means of a mechanical actuator. Also, the back pressure may be controlled as a function of engine load in place of engine rpm or together with engine rpm. In such case, the engine load may be detected by means of the position of an accelerator pedal, engine intake pressure, exhaust pressure, or a like parameter.

Figure 3:
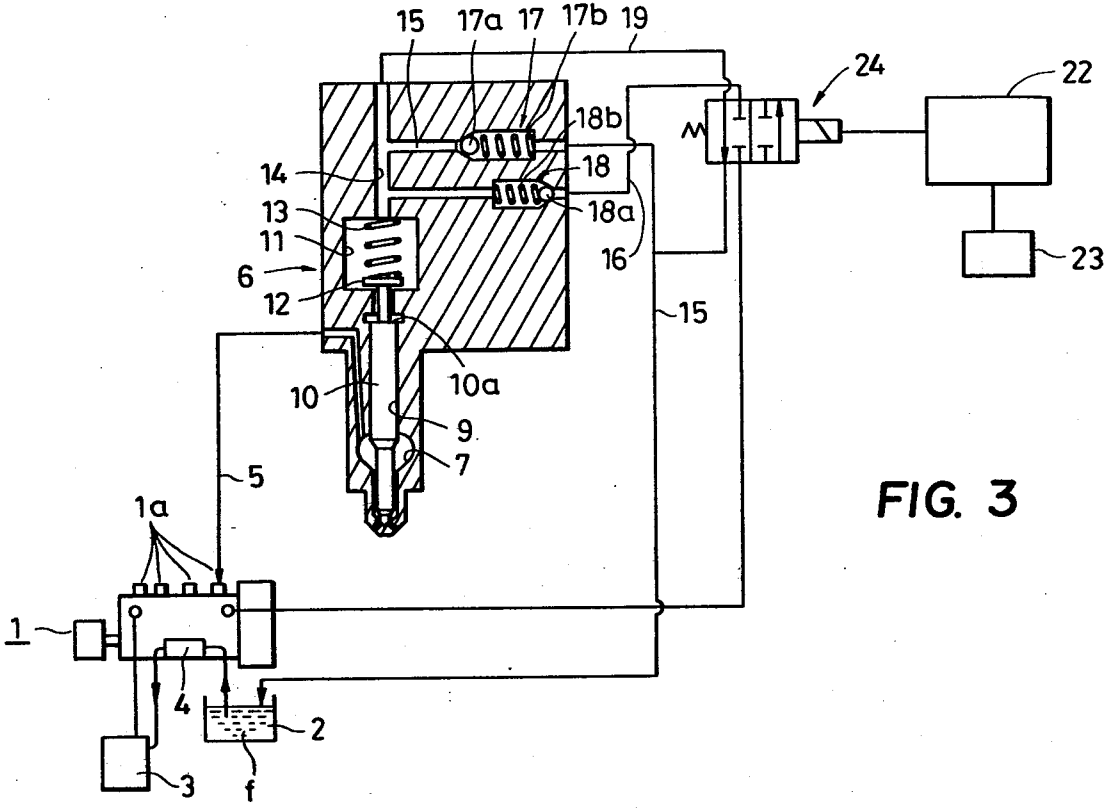
FIG. 3 is a view similar to FIG. 1, illustrating another embodiment of the invention.

FIG. 3 illustrates another embodiment of the invention. The arrangement of this embodiment is distinguished from the arrangement of FIG. 1 only in that a solenoid valve 24, which is a four port/four position type, is used in place of the solenoid valve 20 in FIG. 1, one pair of ports being arranged for opening and closing the second return line 19, and the other pair of ports the supplementary fuel pressure supply line 16, respectively. According to this arrangement, the fuel overflowing from a corresponding suction gallery of the fuel injection pump 1 is not supplied to the nozzle spring chamber 11 until after the engine rpm has exceeded the predetermined value $N_1$. This enables carrying out the control of the back pressure acting upon the nozzle needle 10 with higher accuracy and reduces the burden of the fuel feed pump 4.

Obviously many modifications and variations of the present invention are possible in the light of the above teachings. It is therefore to be understood that within the scope of the appended claims the invention may be practiced otherwise than as specifically described.

What is claimed is:

1. A fuel injection system for combination with an internal combustion engine, comprising:

a fuel injection pump;

pump means for feeding fuel under pressure to said fuel injection pump;

at least one fuel injection valve arranged to be supplied with fuel pumped by said fuel injection pump, said fuel injection valve including a nozzle needle arranged to be lifted by the pressure of said pumped fuel to cause injection of said pumped fuel into said engine, and means elastically urging said nozzle needle against a lifting motion thereof;

first supplementary back pressure applying means for causing the pressure of leaked fuel produced by a lifting motion of said nozzle needle to act upon said nozzle needle against said lifting motion thereof; and second supplementary back pressure applying means responsive to at least one operating condition of said engine for causing the pressure of pressurized fuel suppled from said pump means for supplying said fuel under pressure to act upon said nozzle needle against a lifting motion thereof;

said second supplementary back pressure applying means including:

a first passageway connecting said pump means to said fuel injection valve for feeding pressurized fuel suppled from said pump means and being applied to said nozzle needle;

a second passageway connecting said fuel injection valve to a lower pressure zone for guiding said leaked fuel and said pressurized fuel to said lower pressure zone;

a first valve arranged for opening and closing said second passageway;

a further valve arranged for closing said first passageway when the pressure of fuel acting upon said nozzle against said lifting motion thereof is higher than the pressure of pressurized fuel supplied from said pump means for feeding said fuel under pressure; and valve controlling means responsive to at least one operating condition of said engine for controlling said first valve.

2. The fuel injection system as claimed in claim 1, wherein said valve controlling means causes said first valve to close said second passageway when the rotational speed of said engine is higher than a predetermined value.

3. The fuel injection system as claimed in claim 1, further comprising a third passageway arranged in parallel with said second passageway and bypassing said first valve; and a second valve arranged for opening said third passageway when the pressure of fuel acting upon said nozzle needle against said lifting motion thereof is higher than a predetermined value.

4. A fuel injection system for combination with an internal combustion engine, comprising:

a fuel injection pump;

pump means for feeding fuel under pressure to said fuel injection pump;

at least one fuel injection valve arranged to be supplied with fuel pumped by said fuel injection pump, said fuel injection valve including a nozzle needle arranged to be lifted by the pressure of said pumped fuel to cause injection of said pumped fuel into said engine, and means elastically urging said nozzle needle against a lifting motion thereof;

first supplementary back pressure applying means for causing the pressure of leaked fuel produced by a lifting motion of said nozzle needle to act upon said nozzle needle against said lifting motion thereof; and second supplementary back pressure applying means responsive to at least one operating condition of said engine for causing the pressure of pressurized fuel suppled from said pump means for supplying said fuel under pressure to act upon said nozzle needle against a lifting motion thereof;

said second supplementary back pressure applying means including:

a first passageway connecting said pump means to said fuel injection valve for feeding pressurized fuel suppled from said pump means and being applied to said nozzle needle;

a second passageway connecting said fuel injection valve to a lower pressure zone for guiding said leaked fuel and said pressurized fuel to said lower pressure zone;

a first valve arranged for opening and closing said second passageway;

a third passageway arranged in parallel with said second passageway and bypassing said first valve;

a second valve arranged for opening said third passageway when the pressure of fuel acting upon said nozzle needle against said lifting motion thereof is higher than a predetermined value; and valve controlling means responsive to at least one operating condition of said engine for controlling said first valve.

5. The fuel injection system as claimed in claim 4, wherein said valve controlling means causes said first valve to close said second passageway when the rotational speed of said engine is higher than a predetermined value.

6. The fuel injection system as claimed in claim 5, further including another valve arranged for closing said first passageway when the rotational speed of said engine is lower than said predetermined value, and opening said first passageway when the rotational speed of said engine is higher than said predetermined value.

7. The fuel injection system as claimed in claim 6, wherein said another valve is arranged to be controlled in unison with said first valve by means of said valve controlling means.

8. A fuel injection system for combination with an internal combustion engine, comprising:

a fuel injection pump;

pump means for feeding fuel under pressure to said fuel injection pump;

at least one fuel injection valve arranged to be supplied with fuel pumped by said fuel injection pump, said fuel injection valve including a nozzle needle arranged to be lifted by the pressure of said pumped fuel to cause injection of said pumped fuel into said engine, and means elastically urging said nozzle needle against a lifting motion thereof;

first supplementary back pressure applying means for causing the pressure of leaked fuel produced by a lifting motion of said nozzle needle to act upon said nozzle needle against said lifting motion thereof; and second supplementary back pressure applying means responsive to at least one operating condition of said engine for causing the pressure of pressurized fuel supplied from said pump means for feeding said fuel under pressure to act upon said nozzle needle against a lifting motion thereof directly and without being further pressurized, said second supplementary back pressure applying means including means for applying the pressure of said pressurized fuel to said nozzle needle when said engine is in a high engine speed region where the rotational speed of said engine is higher than a predetermined value.

9. The fuel injection system as claimed in claim 1, wherein said second supplementary back pressure applying means comprises:

a first passageway connecting said pump means to said fuel injection valve for feeding pressurized fuel supplied from said pump means and being applied to said nozzle needle;

a second passageway connecting said fuel injection valve to a lower pressure zone for guiding said leaked fuel and said pressurized fuel to said lower pressure zone;

a valve arranged for opening and closing said second passageway; and valve controlling means responsive to at least one operating condition of said engine for controlling said valve;

whereby when said second passageway is opened by said valve, only said elastically urging means acts on said needle valve against said lifting motion thereof.

10. The fuel injection system as claimed in claim 9, wherein said valve controlling means causes said valve to close said second passageway when said engine is in a high engine speed region where the rotational speed of said engine is higher than said predetermined value.

11. The fuel injection system as claimed in claim 9, further including a third passageway arranged in parallel with said second passageway and bypassing said valve; and a second valve arranged for opening said third passageway when the pressure of fuel acting upon said nozzle needle against said lifting motion thereof is higher than a predetermined value.

12. The fuel injection system as claimed in any of claims 9, 10 or 11, further including a third valve arranged for closing said first passageway when the pressure of fuel acting upon said nozzle against said lifting motion thereof is higher than the pressure of pressurized fuel supplied from said pump means for feeding said fuel under pressure.

13. The fuel injection system as claimed in claim 10, further including a fourth valve arranged for closing said first passageway when the rotational speed of said engine is lower than said predetermined value, and opening said first passageway when the rotational speed of said engine is higher than said predetermined value.

14. The fuel injection system as claimed in claim 13, wherein said fourth valve is arranged to be controlled in unison with the first-mentioned valve by means of said valve controlling means.

* * * * *

UNITED STATES PATENT AND TRADEMARK OFFICE

CERTIFICATE OF CORRECTION

PATENT NO. : 4,440,135

DATED : April 3, 1984

INVENTOR(S) : Toshiaki ASAMI

It is certified that error appears in the above-identified patent and that said Letters Patent is hereby corrected as shown below:

COLUMN 6, line 14, after "fuel" change "suppled" to --supplied--;
line 21, after "fuel" change "suppled" to --supplied--;

COLUMN 7, line 9, after "fuel" change "suppled" to --supplied--;

COLUMN 8 (claim 9), line 12, after "in claim" change "1" to --8--.

Signed and Sealed this

*Twelfth* Day of *February 1985*

[SEAL]

*Attest:*

DONALD J. QUIGG

*Attesting Officer* *Acting Commissioner of Patents and Trademarks*